United States Patent [19]

Uppstu

[11] Patent Number: 5,007,354

[45] Date of Patent: Apr. 16, 1991

[54] COMBUSTION AIR SUPPLY SYSTEM FOR A RECOVERY FURNACE

[75] Inventor: Erik Uppstu, Siivikkala, Finland

[73] Assignee: Oy Tampella Ab, Tampere, Finland

[21] Appl. No.: 480,926

[22] Filed: Feb. 16, 1990

[30] Foreign Application Priority Data

Feb. 20, 1989 [FI] Finland ..... 890803

[51] Int. Cl.[5] ..... F23G 7/04

[52] U.S. Cl. ..... 110/238; 110/297; 122/7 C

[58] Field of Search ..... 110/238, 297; 122/7 C

[56] References Cited

U.S. PATENT DOCUMENTS 3,413,936 12/1968 Matthews ..... 122/7 C X
3,703,919 11/1972 Owens et al. ..... 122/7 C X
4,462,319 7/1984 Larsen ..... 122/7 C X

FOREIGN PATENT DOCUMENTS 759257 5/1967 Canada ..... 122/7 C
1138880 3/1954 Fed. Rep. of Germany ..... 122/7 C

*Primary Examiner*—Edward G. Favors
*Attorney, Agent, or Firm*—Pollock, Vande Sande & Priddy

[57] ABSTRACT

In a combustion air supply system, particularly a secondary air supply system for a recovery furnace, the secondary air inlet ports are divided into two arrays in such a manner that the combustion air coming in through the inlet ports of the first array is directed in part to contact and in part to by-pass a central region in the outer surface of a carbonization layer. The combustion air coming in through the inlet ports of the second array is directed to by-pass the combustion air coming in through the inlet ports of the first array thereabove. The first and second arrays are located on the opposite walls of the combustion chamber, preferably on the front and rear walls. The recovery furnace further comprises a primary air supply zone for blowing combustion air onto the sides of the carbonization layer and a tertiary air supply zone above a waste liquor inlet.

11 Claims, 4 Drawing Sheets

COMBUSTION AIR SUPPLY SYSTEM FOR A RECOVERY FURNACE

BACKGROUND OF THE INVENTION

The present invention relates to a combustion air supply system for a recovery furnace.

Particularly in recovery furnaces, so-called soda furnaces, designed for processing the waste liquor, so-called black lye, produced in certain manufacturing processes of paper industry, there often occur problems relating to operation, emissions and processes resulting from a combustion air supply system which has been a long-standing problem in the art. In the combustion or firing chambers of a recovery furnace designed with traditioanl combustion air supply systems, the combustion-air flows coming particularly through so-called secondary air inlet ports from all the walls of a combustion chamber on substantially the same horizontal plane, join together in the corner regions of a combustion chamber to form powerful diagonal flows directed towards the center of the combustion chamber. These flows directed from the corners towards the center of a combustion chamber merge into each other at the center of the combustion chamber and produce a powerful flow directed upwards in the center of a combustion chamber. On the basis of experiments it has been found that the rate of this local flow can be more than 15 m/s, which is a rate or velocity approximately four times higher than the average upward velocity of flue gases in a combustion chamber. Since black lye is delivered into a combustion chamber by injection in vertical direction above secondary-air ports, it is obvious that some of the black lye in the form of droplets is entrapped in the upward-directed powerful flue-gas flow which carries the droplets to the upper section of the combustion chamber and to its overhead superheaters. The droplets burn completely out, thus causing within this region too high a temperature, cloggings, corrosion and sulphur ($SO_2$, $H_2S$) emissions higher than normal. It is also know that, as some of the fuel burns out "in a wrong place", temperature in the lower section of a combustion chamber, wherein the fuel is supposed to burn out completely, will be lower than it would be if the processing advanced in a desired manner so that the entire amount of black lye would end up in in a caronization layer formed in the bottom section of a combustion chamber. This naturally lowers the efficiency of the processing or the reduction of sulphur.

SUMMARY OF THE INVENTION

An object of this invention is to provide a combustion air supply system for a recovery furnace, capable of eliminating a great deal of the above problems and, thus, improving considerably the process of the recovery furnace.

In order to achieve the above object, a combustion air supply system of the invention is principally characterized in that the combustion air inlet ports, so-called secondary air inlet ports, located between the black liquor supply point and a carbonization layer formed on the floor of a combustion chamber during the processing and extending in the vertical direction of a combustion chamber, are divided into two arrays in such a manner that the combustion air coming in through the first array of inlet ports is at least partially directed to contact and pass the outer surface of a carbonization layer, especially the central region of a carbonization layer, the combustion air coming in through the second array of inlet ports is adapted to pass above the combustion air coming through the first array of inlet ports, and the inlet ports making up the first and second array are located on the opposite walls of a combustion chamber, preferably on the front and rear wall.

With the above-described combustion air supply system, the combustion air flows coming through the first and second array of inlet ports by-pass each other without actually colliding with each other. This prevents the formation of powerful resultant flows and the flue-gas flow directed upwards from the region of secondary-air ports is substantially more peaceful and uniform over the entire horizontal cross-surface area of a combustion chamber. Thus, the droplets coming into a combustion chamber through the waste liquor inlet are carried downwards into a carbonization layer in a uniform air zone for drying the droplets. In addition, the supply system facilitates the conditioning of the surface of a carbonization layer, which in terms of the process of a recovery furnace is the most important subsection thereof, particularly the conditioning of its central region. Usually, the side faces of a cone-shaped carbonization layer are subjected to a so-called primary air flow through primary-air ports located vertically below the secondary-air ports. Thus, the entire carbonization layer can be maintained active and the process can be run at maximum efficiency. In addition, the combustion air coming in through the first array of inlets maintains the height of a carbonization layer substantially constant, as it is directed to contact the central region of a cone-shaped carbonization layer, in which region the height of a cone-shaped carbonization layer tends to increase, especially when using traditional combustion air supply systems. A combustion air supply system of the invention can be accompanied by a tertiary-air supply system, which is mounted above the waste liquor inlet and similarly constructed by applying the principle of arraying. The provision of inlet ports belonging in the arrays on the opposite walls of a combustion chamber produces a substantially uniform distribution of the flow over the entire cross-surface area. It is preferable that the inlet ports be provided on the front and rear wall, whereby the flow is symmetrical in transverse direction, that is in sections taken orthogonally to the side walls. The transverse direction is a critical direction in terms of the operations of a recovery furnace, for example in terms of the loading of superheaters. The flow is also sufficiently symmetrical in longitudinal sections taken in a direction orthogonal to the above-mentioned direction. However, this direction is not quite as critical in terms of the operations of a recovery furnace.

It is obvious that a supply system of the present invention can be modified in many different ways within the scope of the basic idea. A few preferred embodiments of a combustion air supply system of the invention for a recovery furnace are set forth in the annexed non-independent claims.

The invention will now be described in more detail with reference made to the accompanying drawings. In the drawings

DETAILER DESCRIPTION OF THE PREFERRED EMBODIMENTS

Figure 1:
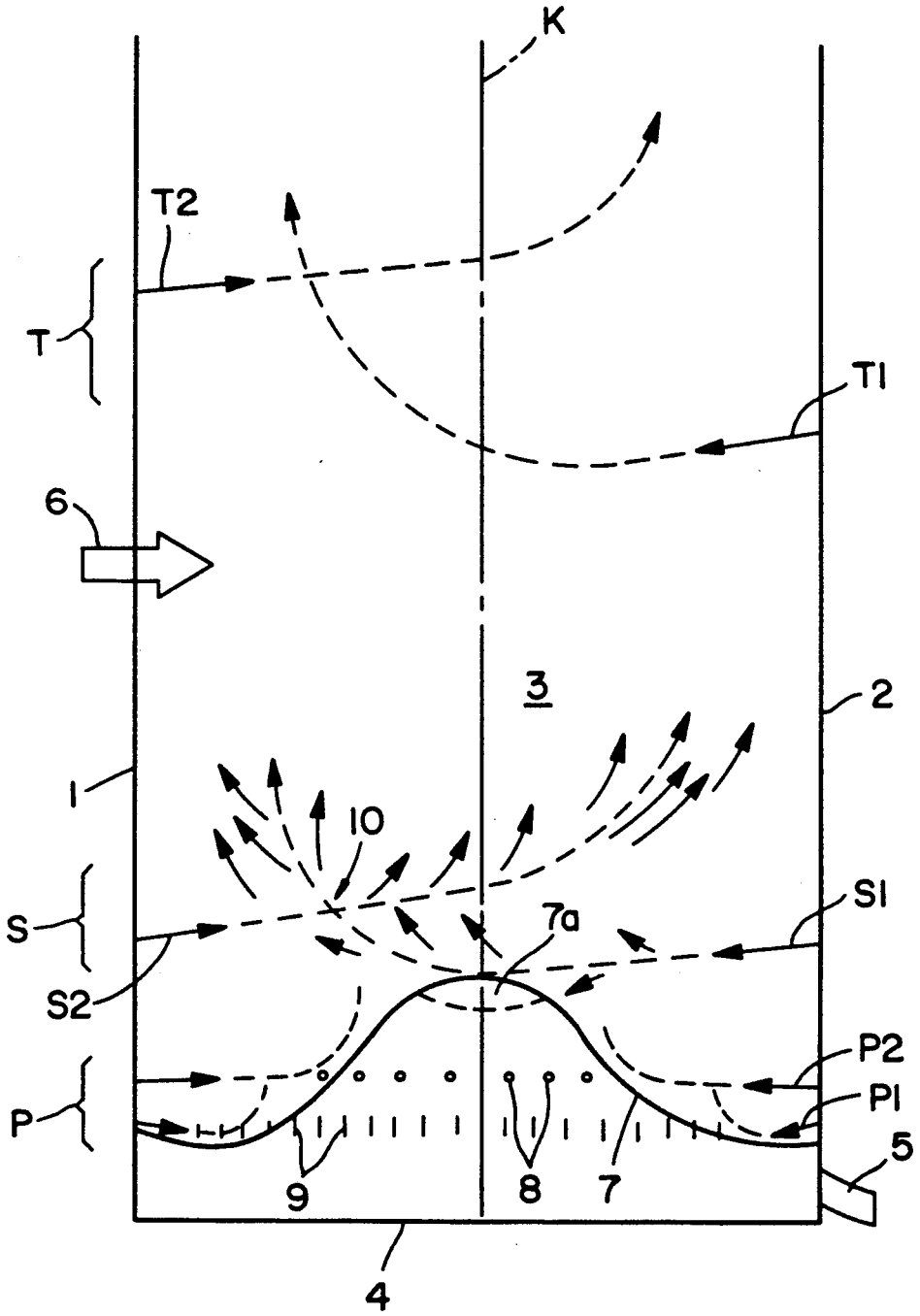
FIG. 1 shows schematically and in a vertical section the combustion chamber of a recovery furnace embodying one embodiment of a combustion air supply system of the invention.

The combustion chamber shown in FIG. 1 comprises a front wall 1 and a rear wall 2 as well as two side walls 3. The combustion chamber of a recovery furnace having a rectangular and square-shaped cross-section. The combustion chamber includes a floor 4 attached to the lower wall portions. The rear wall is provided in its lower portion with a melt matter outlet and discharge chute, indicated by reference numeral 5. The inlet of waste liquor in vertical direction is indicated by an arrow 6. The surface of a cone-shaped carbonization layer being built on the combustion chamber floor is indicated by a curved line 7.

In the illustrated embodiment, the supply of combustion air is effected at three different main stages. The supply of so-called primary air P occurs onto the surfaces of a carbonization layer at the level. Between the top portion of a carbonization layer (the highest portion 7*a* in the middle of a combustion chamber, that is the central region) and the waste liquor inlet (arrow 6) in vertical direction occurs so-called secondary air supply S. Above the waste liquor inlet (arrow 6) occurs so-called tertiary air supply T.

The primary air supply P is effected at two levels through inlet ports made in each wall. A first and lower primary air supply level P1 has an effect on the the surface of a carbonization layer in the portion closest to walls 1-3. A second primary air supply level P2 has an effect on the side faces of a carbonization layer at higher level. The second primary air supply level P2 is arranged in such a manner that the corresponding horizontally aligned inlet ports 8 are located in the central region of each wall while the lower, first air supply level P1 is arranged in such a manner that the corresponding horizontally aligned inlet ports 9 are located over the entire width of each wall. According to the invention, the secondary air supply S is divided into two arrays S1 and S2. In the embodiment of FIG. 1, the inlet ports located in rear wall 2 make up the first array S1. The combustion air coming through the inlet ports of this array S1 is directed to the outer surface of a carbonization layer 7 in such a manner that at least part of it encounters the central portion 7*a* of a carbonization layer and by-passes the center line K of carbonization layer and combustion chamber and deflects upwards near the front wall 1 according to the main flow direction shown by dash-and-dot lines in FIG. 1. The combustion air coming in through inlet ports included in the first array S1 can be directed, as shown in FIG. 1, either diagonally downwards to contact the central region of a carbonization layer or the combustion air flow can be directed horizontally. The orientation of combustion air can be made adjustable.

The inlet ports included in the second array S2 of secondary air supply S are located on the front wall 1 of a combustion chamber in the embodiment of FIG. 1. The second array S2 is arranged in such a manner that combustion air by-passes above the combustion air coming in through the inlet ports of first array S1. If, as in the embodiment of FIG. 1, the inlet ports of first array S1 and second array S2 are horizontally arranged at a substantially common level, the combustion air coming in through the inlet ports of second array S2 is directed diagonally upwards as shown in FIG. 1, the main flow of combustion air proceeding as depicted by dash-and-dot lines in FIG. 1, the flow direction of combustion air traversing the center line K of a combustion chamber and deflects more dramatically upwards near the rear wall 2 of a combustion chamber. The combustion air flow coming in through the inlet ports of second array S2 can also be made horizontal, preferably in such a manner that the inlet ports are located in vertical direction at a higher level than those of first array S1. It is preferable to stagger the inlet ports in the front and rear wall particularly in such a manner that a combustion air flow coming through a given inlet port included in first array S1 is directed in between two adjacent inlet ports included in second array S2 and vice versa. Thus, the combustion air flows criss-cross each other at a point 10 of FIG. 1 near the front wall without substantial disturbances since the combustion air flows directed from the adjacent inlet ports of second array S2 are fresh out of the inlet port and thus relatively powerful and, hence, distributed over rather small cross-sectional areas, which is why the combustion air flow from the first array, which is already more peaceful and distributed over a larger cross-sectional area, will be able to by-pass the two adjacent combustion air flows therebetween.

The tertiary air supply T is also effected according to FIG. 1 by the application of an array distribution. The rear wall 2 is provided with inlet ports making up the first array T1, a combustion air flow coming therethrough being directed diagonally downwards, the main flow direction of combustion air following the trajectory shown by dash-and-dot lines towards front wall 1 and upwards. Correspondingly, the front wall is provided at a higher level if compared to the first array T1 with a second array T2 of tertiary air supply, a combustion air flow coming through its inlet ports being directed diagonally upwards, the main flow direction of combustion air following the trajectory shown by dash-and-dot lines towards rear wall 2 and upwards. The alternative embodiments corresponding to secondary air supply S apply also to tertiary air supply T and, thus, are not discussed further in this context. The above-described overall arrangement of secondary and tertiary air supplies is capable of providing an alternating or staggered overall air supply system, since in vertical direction the combustion air flows coming from the front wall on the one hand and from the rear wall on the other hand stagger or alternate one after the other.

FIGS. 2-5 illustrate schematically in more detail a combustion air supply system of the invention, particularly in terms of the disposition of inlet ports of arrays S1 and S2 and the orientations of combustion air flows coming therethrough, the arrays being positioned in two opposite walls either by having the entire arrays in different walls or by dividing the arrays on opposite walls in a manner that one and the same wall carries inlet ports included both in the first and in the second array.

Figure 2:
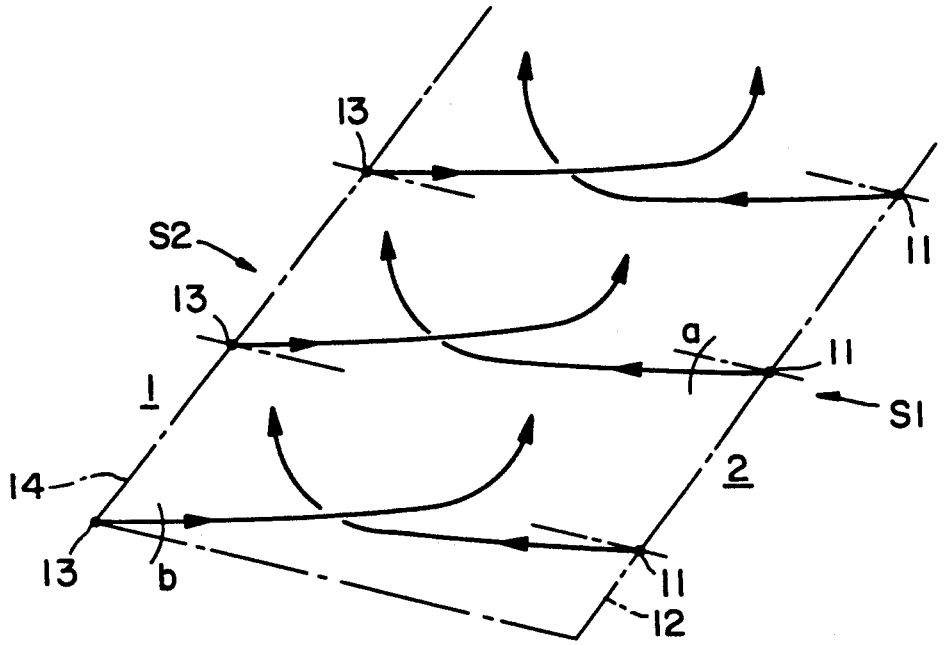
FIGS. 2-6 are schematic perspective views a few alternative embodiments for a combustion air supply system of the invention.

FIG. 2 illustrates schematically the embodiment of secondary air supply S shown in FIG. 1. The rear wall 2 includes at fixed intervals inlet ports 11 set in a horizontal line 12. Inlet ports 11 are staggered relative to inlet ports 13 of a row 14 of inlet ports provided on front wall 1 as viewed in the longitudinal direction of the cross-section of a combustion chamber. The air flows coming in from inlet port 11 are directed diagonally downwards (angle a). Respectively, the air flows coming in from inlet ports 13 are directed diagonally upwards (angle b). the rows 12 and 14 of inlet ports are located at the same horizontal level.

Figure 3:
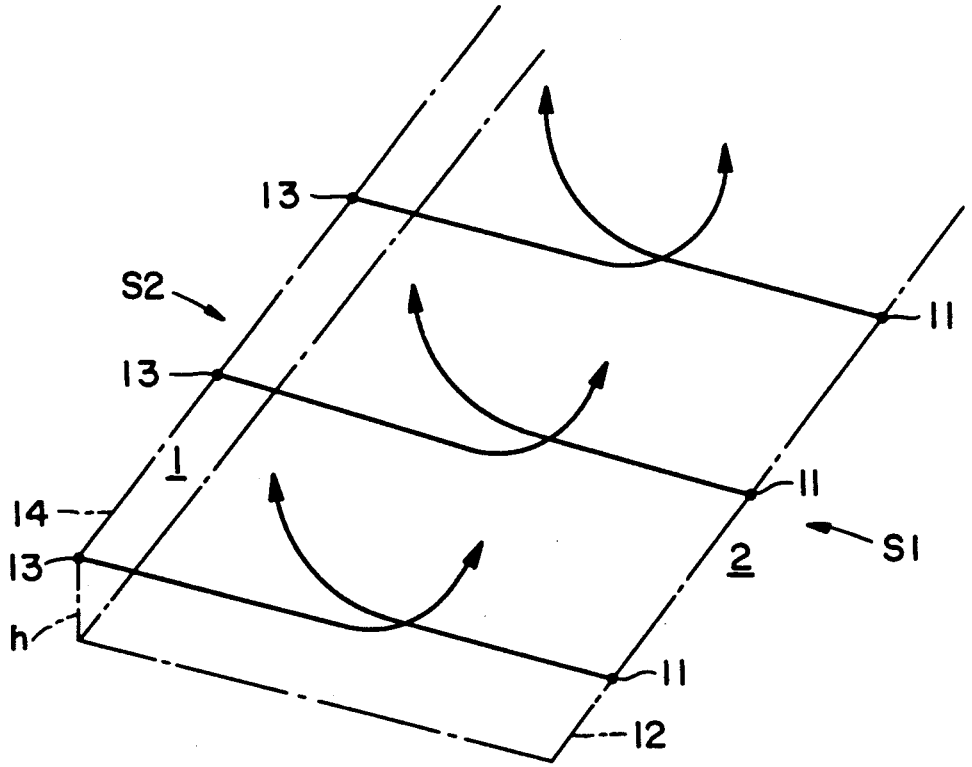

FIG. 3 illustrates the arrangement of secondary air supply S, wherein the inlet ports of inlet port rows on the front and rear wall are staggered in the horizontal cross-section of a combustion chamber as viewed in the longitudinal direction of a recovery furnace. In addition, the inlet ports 13 included in a row 14 of inlet ports formed in the front wall are located in vertical direction at a higher level (dimension h) than the inlet ports 11 included in a row 13 of inlet ports formed in rear wall 2. Thus, the combustion air flows issuing from inlet ports 11, 13 can be directed in horizontal direction, as shown in FIG. 3. The vertical position of a row of inlet ports in first array S1 is such that the combustion air flows come into contact with central region 7*a* of a carbonization layer.

The embodiments shown in FIGS. 2 and 3, wherein the first S1 and second S2 array are provided on different walls, can naturally be combined in a variety of ways, particularly in terms of the orientation of combustion air flows.

Figure 4:
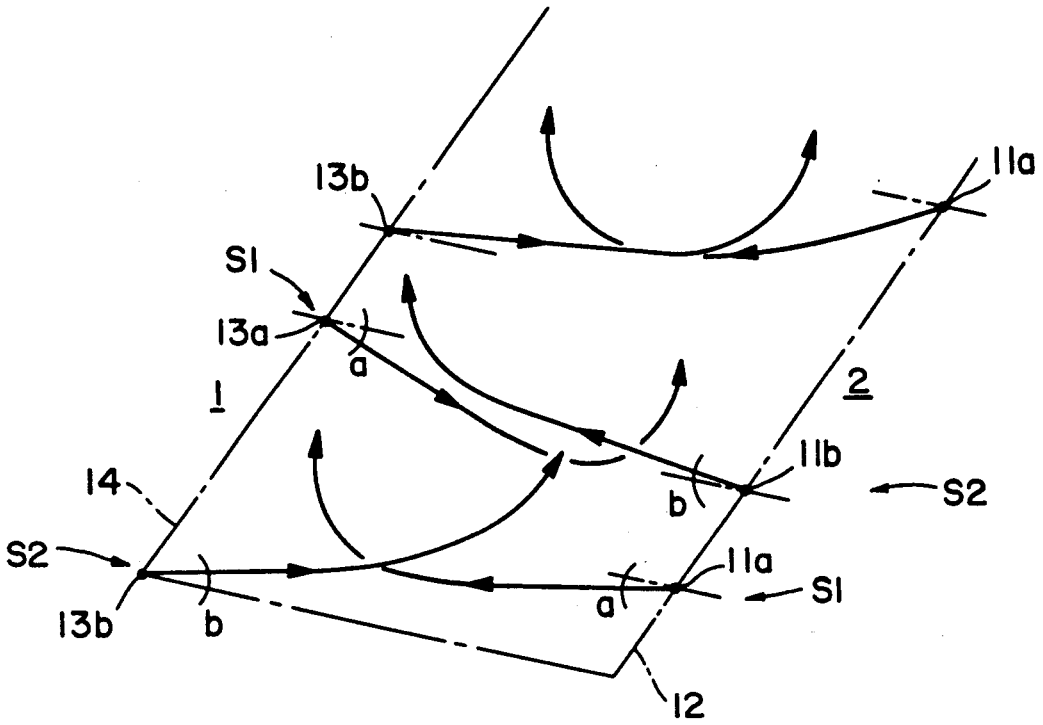

FIG. 4 illustrates the arrangement of secondary air supply S, wherein every other inlet port 11*a* of a row 12 of inlet ports located in rear wall 2 of a combustion chamber in included in the first array S1, whereby the combustion air flow is directed diagonally downwards (angle a), and every other inlet port 11*b* is included in the second array S2, whereby the combustion air flow is directed diagonally upwards (angle b). The corresponding arrangement applies to inlet ports 13*a*, 13*b* of a row 14 of inlet ports located in front wall 1. Thus, both inlet ports 11*a* and 13*a* making up the first array S1 and inlet ports 11*a* and 11*b* making up the second array S2 are staggered relative to each other in a manner that combustion air flows will be staggered both within and between the arrays. This can be achieved in a manner that in both rows of inlet ports a pair of inlet ports provided by two adjacent inlet ports is staggered relative to similarly established adjacent pairs of inlet ports in the opposite wall. Each pair of inlet ports includes an inlet port belonging both to the first and to the second array, whereby in both rows 12, 14 of inlet ports the first inlet ports of the pairs of inlet ports in their longitudinal direction are included in the same array and vice versa.

Figure 5:
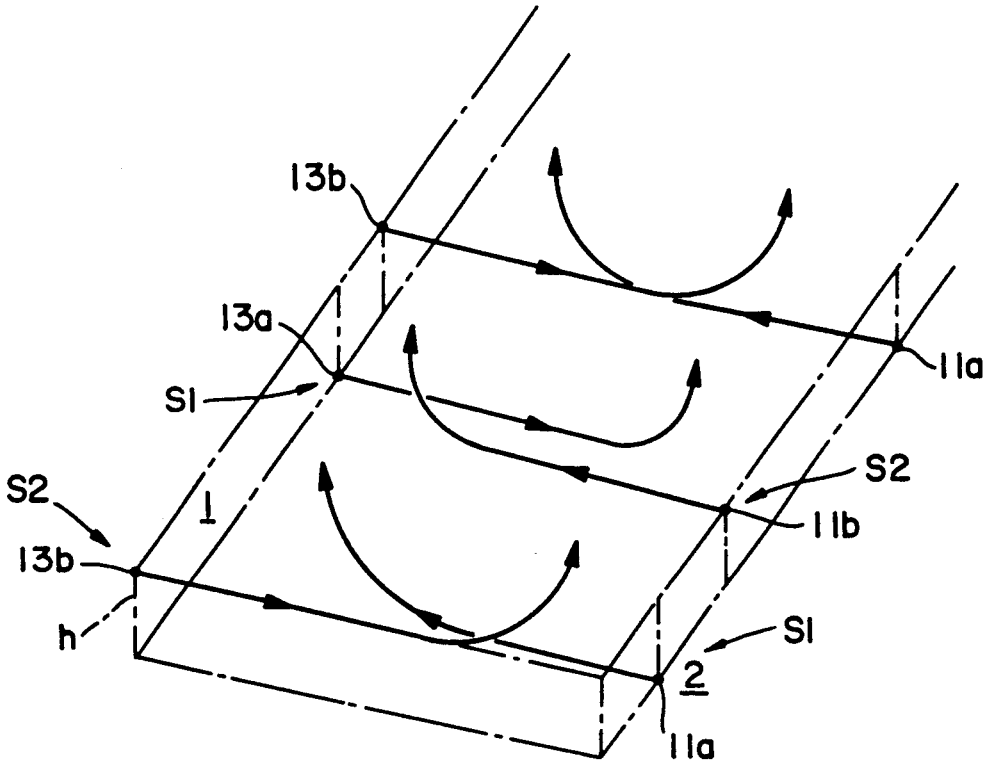

A similar arrangement is established also in the system of secondary air supply S shown in FIG. 5, wherein the relatively staggered first array S1 (inlet ports 11*a*, 13*a*) and second array S2 (inlet ports 11*b* and 13*b*) located in the opposite walls are in vertical direction (dimension h) disposed in different vertical positions and the combustion air flows are adapted to occur in horizontal direction. Arrays S1 and S2 are also staggered relative to each other.

Figure 6:
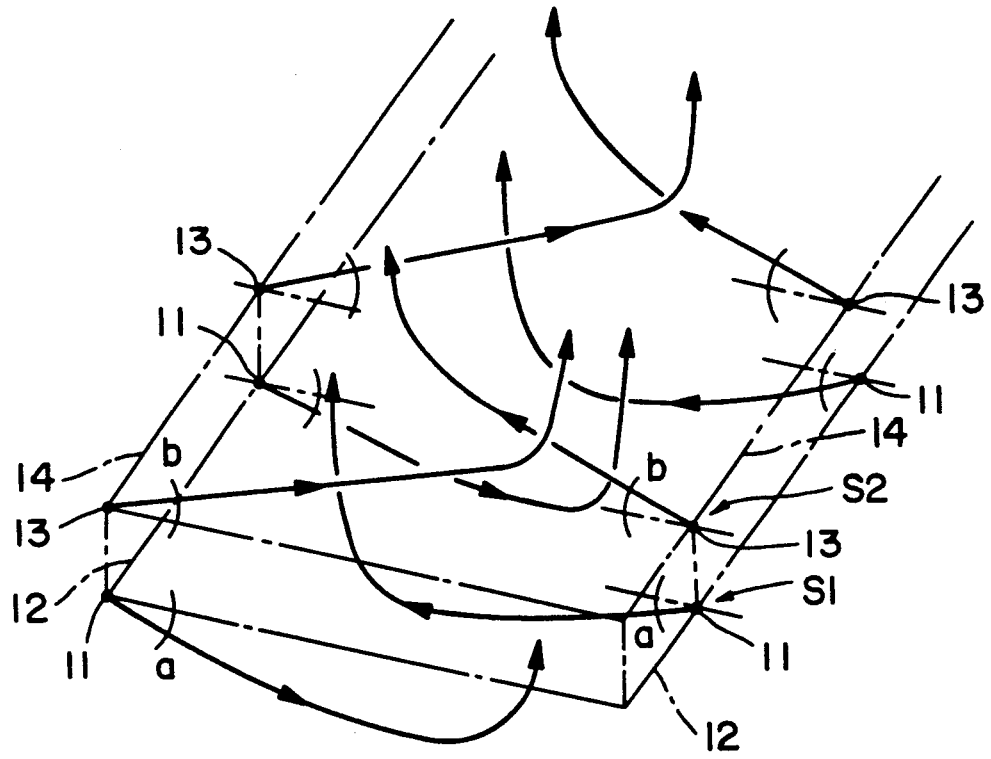

FIG. 6 illustrates the arrangement of secondary air supply S, wherein both front and rear wall are provided with two rows 12, 14 of inlet ports 11, 13. The inlet ports 11, 13 of both rows 12, 14 are positioned on top of each other and the rows of front and rear wall are staggered. The lower row 12 both in front and in rear wall makes up a first array S1, the combustion air flows coming through the inlet ports thereof being directed diagonally downwards (angle a). The upper row both in front and in rear wall makes up a second array S2, the combustion air flows coming through the inlet ports thereof being directed diagonally upwards (angle b). This produces two arrays of combustion air flows staggered with each other inside the particular array.

The embodiments shown in FIGS. 4 and 5, wherein both opposite walls are provided with inlet ports included in both arrays, can of course be combined in terms of flow directions. It is also obvious that all described embodiments can be combined in a variety of ways within the basic concept of the invention.

I claim:

1. A combustion air supply system for a recovery furnace which includes a combustion chamber defined by a front and a rear wall, side walls and a floor serving as heat transfer surfaces, means mounted above the floor for delivering into the combustion chamber a waste liquor, particularly black lye, obtained from an industrial process and serving as fuel, and an outlet means communicating with combustion chamber floor and intended for discharging melt substance from a carbonization layer building up on the floor as a result of incineration, said combustion air supply system comprising:

combustion air inlet ports disposed in at least one wall of the combustion chamber, said combustion air inlet ports including secondary air inlet ports which are located in the vertical direction of the combustion chamber between a waste liquor supply point and the carbonization layer formed on the floor of the combustion chamber during the processing, said secondary air inlet ports being divided into two arrays in such a manner that:

(a) the combustion air coming in through inlet ports of a first array is directed such that at least a portion of the air contact the outer surface of the carbonization layer, and the remaining portion of the air bypasses substantially along the central region of the carbonization layer;

(b) the combustion air coming in through inlet ports of a second array is adapted to bypass substantially above the combustion air coming through inlet ports of the first array; and (c) said inlet ports making up said first and second arrays are located on the opposite walls of the combustion chamber.

2. A supply system according to claim 1, wherein the opposite walls are front and rear walls.

3. A supply system according to claim 1, wherein the inlet ports of first and second arrays are located on different walls of the combustion chamber.

4. A supply system according to claim 1, wherein at least one wall of a combustion chamber is provided with inlet ports included in both first and second arrays.

5. A supply system according to claim 1, wherein the inlet ports included in said first and second arrays are located in the horizontal section of the combustion chamber in a staggered pattern in such a manner that in the main flow direction of combustion air, the combustion air coming in through an inlet port at one wall is, for the most part, directed in between the combustion air flows coming in through adjacent inlet ports located on the opposite wall.

6. A supply system according to claim 1, wherein the inlet ports included in said first and second arrays are located at substantially the same horizontal level, and wherein a combustion air flow occurring through inlet ports included in at least either one of the arrays is deflected from the horizontal plane.

7. A supply system according to claim 1, wherein the combustion air coming in through inlet ports included in the first array is directed diagonally downward to contact the outer surface of the carbonization layer, at least the central region of said carbonization layer.

8. A supply system according to claim 1, wherein the combustion air coming in through the inlet ports included in said second array is directed diagonally upwards.

9. A supply system according to claim 1, wherein the inlet ports included in said first array are in a vertical direction located lower down on the wall of a combustion chamber than the inlet ports included in said second array.

10. A supply system according to claim 2, wherein the inlet ports of said first array are located on the rear wall of said combustion chamber, and wherein the outlet for the melt substance is also located on the side of said rear wall.

11. A supply system according to claim 1, wherein a tertiary air supply system mounted above said waste liquor inlet is also divided into two arrays, said arrays being arranged in a manner corresponding to said secondary air supply system, such that a first array of said tertiary air supply system is located on the same wall as the first array of said secondary air supply system.

* * * * *